US010888503B1

(12) United States Patent
Londeree

(10) Patent No.: US 10,888,503 B1
(45) Date of Patent: Jan. 12, 2021

(54) PACIFIER WITH ONBOARD DROP SENSOR AND NOTIFICATIONS

(71) Applicant: Inga Londeree, Weston, FL (US)

(72) Inventor: Inga Londeree, Weston, FL (US)

( * ) Notice: Subject to any disclaimer, the term of this patent is extended or adjusted under 35 U.S.C. 154(b) by 52 days.

(21) Appl. No.: 16/457,151

(22) Filed: Jun. 28, 2019

Related U.S. Application Data

(60) Provisional application No. 62/849,439, filed on May 17, 2019.

(51) Int. Cl.
*A61J 17/00* (2006.01)
*A61J 17/02* (2006.01)

(52) U.S. Cl.
CPC ..... *A61J 17/1012* (2020.05); *A61J 2200/70* (2013.01); *A61J 2205/70* (2013.01)

(58) Field of Classification Search
CPC ..... A61J 17/10; A61J 17/101; A61J 17/1011; A61J 17/1012; A61J 2200/70; A61J 2205/70; G08B 21/0233; G08B 21/028
USPC ..... 606/234, 235, 236
See application file for complete search history.

(56) References Cited

U.S. PATENT DOCUMENTS 5,522,847 A * 6/1996 Kalis ..... A61J 17/1012 606/234
5,662,685 A * 9/1997 Uhler ..... A61J 17/1011 606/234
6,102,935 A * 8/2000 Harlan ..... A61J 17/001 606/234
8,810,374 B1 * 8/2014 Giegoldt ..... G08B 21/24 340/10.4
2008/0140119 A1 * 6/2008 Machtiger ..... A61J 17/103 606/234
2009/0198275 A1 * 8/2009 Godown ..... A61J 17/1011 606/236
2012/0095722 A1 * 4/2012 Ten Kate ..... A61B 5/1117 702/141
2014/0296661 A1 * 10/2014 Zwartkruis-Pelgrim ..... A61B 5/01 600/301
2018/0207065 A1 * 7/2018 Tepper ..... A61J 17/1012

* cited by examiner

*Primary Examiner* — Matthew F Desanto

(57) ABSTRACT

A baby pacifier having a means to sense when it is dropped from an infant's mouth. The invention being comprised of a conventional, flexible pacifier with an onboard drop sensor therein. When the pacifier is dropped and contacts the ground or floor, the device senses the resulting vibration and sends a small audible sound along with a flash from a light emitting diode (LED) to notify the parent it has been dropped. Other embodiments of the invention can include different forms of notifications when they are dropped—for example, some can vibrate; some can activate when hearing a parents voice, a baby's cry, or to clapping. Still other embodiments allow parents to customize their own sound notifications when the device is dropped. An object of the invention is to minimize lost pacifiers by getting a parent's attention when the pacifier falls from an infant's mouth so they can recover it.

8 Claims, 3 Drawing Sheets

PACIFIER WITH ONBOARD DROP SENSOR AND NOTIFICATIONS

CROSS-REFERENCE TO RELATED APPLICATIONS

This application claims the benefit of U.S. Provisional Patent Application No. 62/849,439 filed in 2018.

FIELD OF THE INVENTION

The present invention generally relates to infant accessories. More specifically, it relates to a pacifier with a drop sensor and notifications.

BACKGROUND

Pacifiers, also referred to as teething toys or binkies, have been around for centuries. One of the earliest pacifiers was made of animal bone and some were later combined with rattles in the 1700s. In the 1800s, the europeans wrapped a lump of meat or fat inside a cloth that was sometimes moistened with brandy and others wrapped sweetened bread in cloth for teething. In the mid 1800s, ring-shaped pacifiers made of rubber became popular and in the early 1900s Sears, Roebuck & Co. developed a pacifier with both hard and soft ends. With the popularity of plastic compounds, the infant industry has developed a myriad of pacifiers in recent years. U.S. Pat. No. D745283S1 and U.S. D745283S1 granted to Phillips et. al. and Herbst respectively teaches a pacifier combined with a toothbrush. International Patent No.s 2001022914A1 and 1999048460A1 granted to Badalamenti disclosed a pacifier having gel inserts. U.S. Patent No.s 20090192547 and 20090299410 granted to Gates and Brabant respectively, teach of pacifiers that double as infant toys. U.S. Patent No. US20080140119A1 granted to Machtiger et. al. disclosed a pacifier with a drop alarm; however, it is based on a temperature sensor and not a shock sensor. U.S. Pat. Nos. 4,716,902A and 6,809,644B1 granted to Swartz et. al. and Titus et. al disclosed pacifiers with an LED inside for locating the pacifier. While pacifiers have become more sophisticated, none were found in the prior art that allow a pacifier to emit a sound when dropped from an infant's mouth by means of a shock sensor.

SUMMARY OF THE INVENTION

The device herein disclosed and described provides a solution to the shortcomings in the prior art through the disclosure of a pacifier with a drop alarm notification. An object of the invention is to minimize disruption to an infant who is using a pacifier. The current disclosure will allow a parent to retrieve a dropped pacifier, clean it and allow the baby to continue enjoying the pacifier.

Another object of this invention is to notify a parent when a pacifier has been dropped by a baby. When the pacifier is dropped, an onboard shock sensor detects when the pacifier contacts the ground and sends a signal to an audible alarm to notify a parent that it is now ready to be retrieved. Another object of the invention is to notify a parent of a dropped pacifier using a visual notification in the form of a blinking light—this may assist grandparents with hearing issues. Another object of the invention is to provide audio and visual alerts for an extended period after the pacifier has been dropped in order to give parents enough time to locate the pacifier.

Another object of this invention is to minimize the costs associated with lost pacifiers. Pacifiers have become more complex and are made with a wider array of materials in the past and prices have steadily become higher over the years. Allowing a parent to find pacifiers can help in a small way to save money for other more important child care needs. Another object of this invention is to minimize stress to parents whose children constantly loose pacifiers subsequently making child rearing more pleasant for both the child and the parent.

It is briefly noted that upon a reading this disclosure, those skilled in the art will recognize various means for carrying out these intended features of the invention. As such it is to be understood that other methods, applications and systems adapted to the task may be configured to carry out these features and are therefore considered to be within the scope and intent of the present invention, and are anticipated. With respect to the above description, before explaining at least one preferred embodiment of the herein disclosed invention in detail, it is to be understood that the invention is not limited in its application to the details of construction and to the arrangement of the components in the following description or illustrated in the drawings. The invention herein described is capable of other embodiments and of being practiced and carried out in various ways which will be obvious to those skilled in the art. Also, it is to be understood that the phraseology and terminology employed herein are for the purpose of description and should not be regarded as limiting.

As such, those skilled in the art will appreciate that the conception upon which this disclosure is based may readily be utilized as a basis for designing of other structures, methods and systems for carrying out the several purposes of the present disclosed device. It is important, therefore, that the claims be regarded as including such equivalent construction and methodology insofar as they do not depart from the spirit and scope of the present invention. As used in the claims to describe the various inventive aspects and embodiments, "comprising" means including, but not limited to, whatever follows the word "comprising". Thus, use of the term "comprising" indicates that the listed elements are required or mandatory, but that other elements are optional and may or may not be present. By "consisting of" is meant including, and limited to, whatever follows the phrase "consisting of". Thus, the phrase "consisting of" indicates that the listed elements are required or mandatory, and that no other elements may be present. By "consisting essentially of" is meant including any elements listed after the phrase, and limited to other elements that do not interfere with or contribute to the activity or action specified in the disclosure for the listed elements. Thus, the phrase "consisting essentially of" indicates that the listed elements are required or mandatory, but that other elements are optional and may or may not be present depending upon whether or not they affect the activity or action of the listed elements.

The objects features, and advantages of the present invention, as well as the advantages thereof over existing prior art, which will become apparent from the description to follow, are accomplished by the improvements described in this specification and hereinafter described in the following detailed description which fully discloses the invention, but should not be considered as placing limitations thereon.

BRIEF DESCRIPTION OF THE FIGURES

The accompanying drawings, which are incorporated herein and form a part of the specification, illustrate some, but not the only or exclusive, examples of embodiments and/or features.

Figure 1:
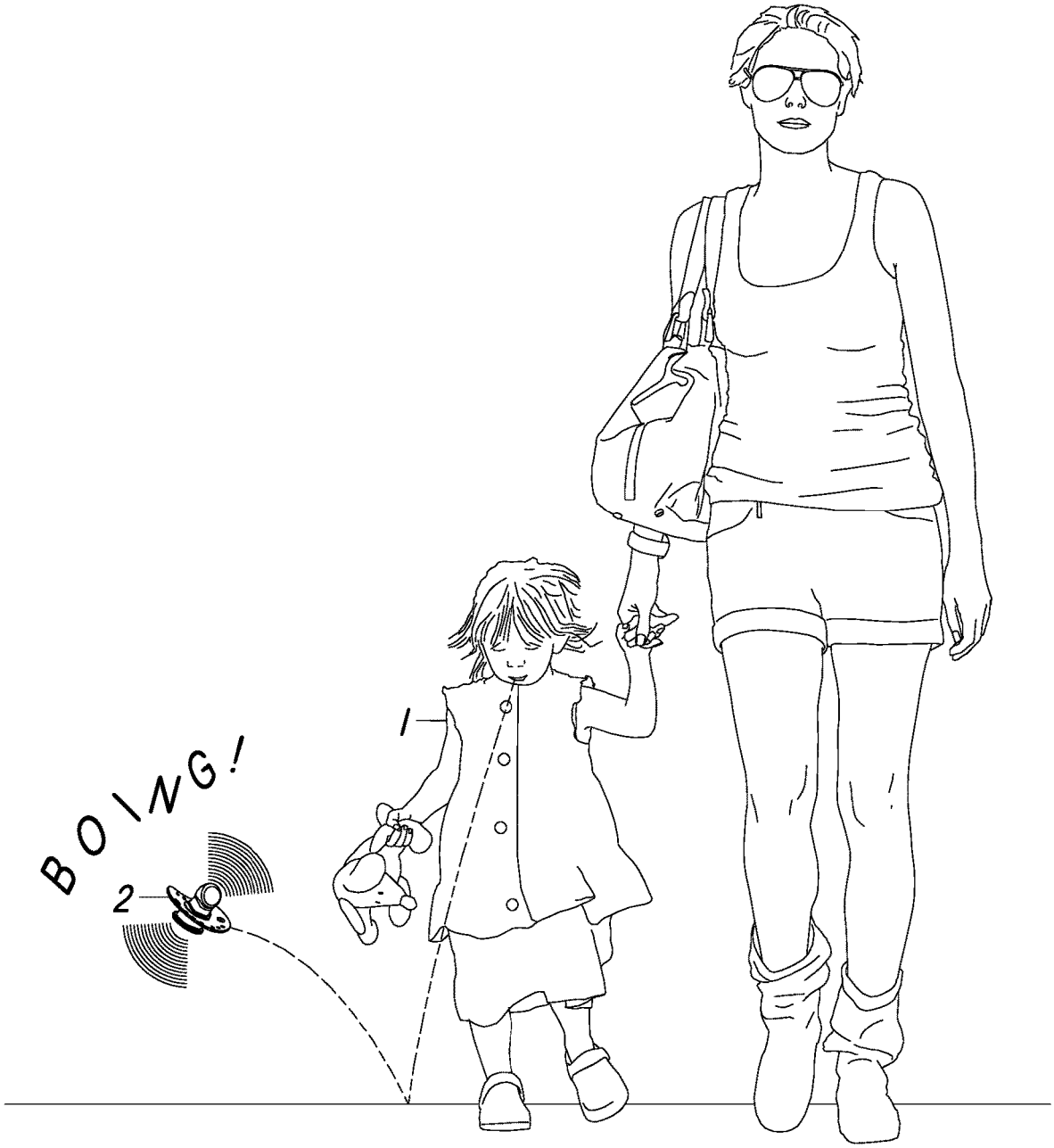
FIG. 1 showing a perspective view of the invention in use.

Other aspects of the present invention shall be more readily understood when considered in conjunction with the accompanying drawings, and the following detailed description, neither of which should be considered limiting.

DETAILED DESCRIPTION OF FIGURES

In this description, the directional prepositions of up, upwardly, down, downwardly, front, back, top, upper, bottom, lower, left, right and other such terms refer to the device as it is oriented and appears in the drawings and are used for convenience only; they are not intended to be limiting or to imply that the device has to be used or positioned in any particular orientation.

Figure 4:
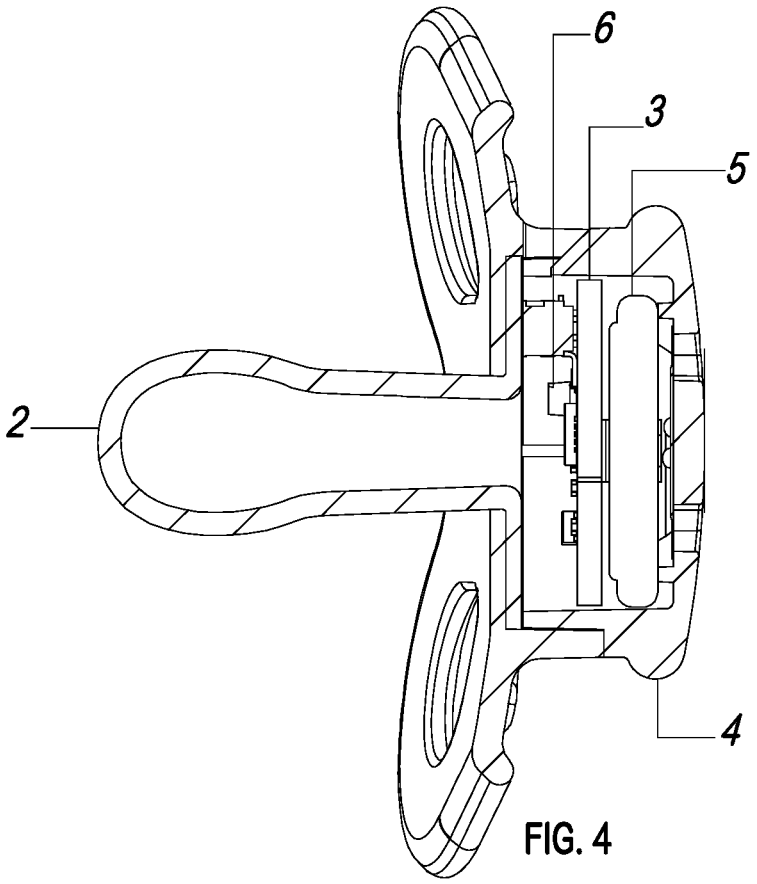
FIG. 4 showing a section view of the invention.
Figure 3:
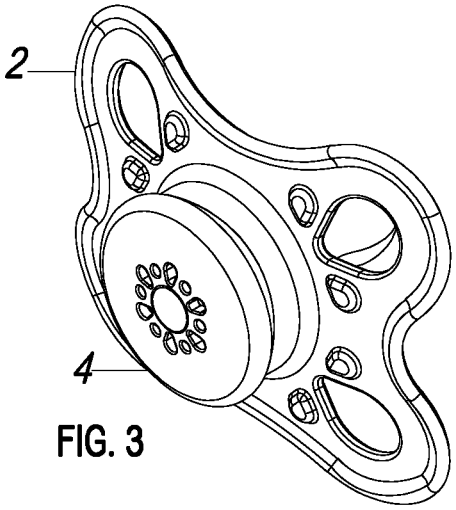
FIG. 3 showing a rear perspective view of the invention.
Figure 2:
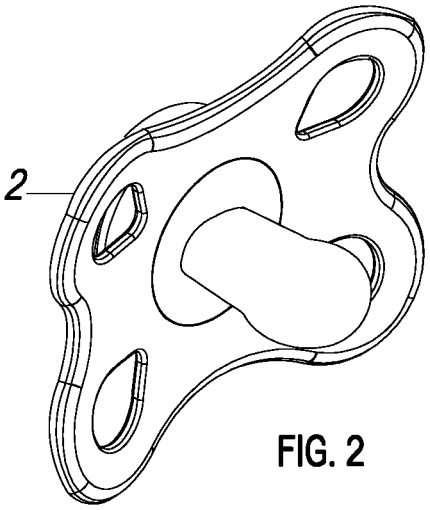
FIG. 2 showing a front perspective view of the invention.
Figure 5:
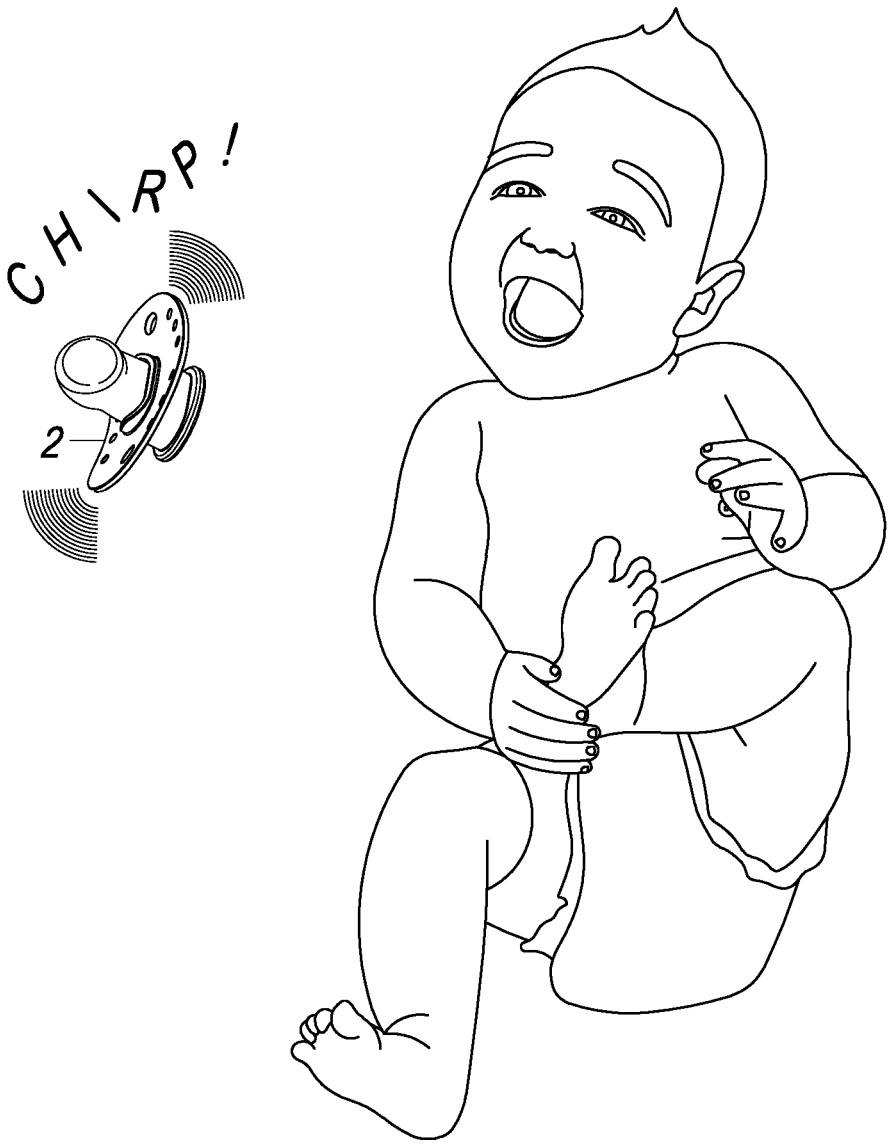
FIG. 5 showing a view of the invention being used by an infant.

FIG. 1 showing the invention 2 being used by a toddler and illustrating how when the device is bounced it makes an audible alert. The sound can include but not limited to a 'boing' sound, a bird chirp etc. In some embodiments, sounds can be programmed by a user or uploaded the device to accommodate sound files from the internet. Other embodiments of the invention can include different forms of notifications when they are dropped—for example, some can vibrate; some can activate when hearing a parents voice, a baby's cry, or to clapping. Still other embodiments allow parents to customize their own sound notifications when the device is dropped. FIGS. 2 and 3 showing a close-up perspective view of the invention 2 being comprised of a conventional pacifier with a recessed cavity inside to receive components (to be discussed in another figure) and receive front lid 4. Said invention pacifier being made of a flexible yet rigid material such as but not limited to rubber, silicone and the like. FIG. 4 showing section view of the invention with font lid 4, speaker 5, LED 6, and microcontroller 3 therein. Said microcontroller having but not being limited to: an onboard shock sensor, flash memory to store the audible sound and a replaceable battery—such as but not limited to nickel hydride, lithium ion and the like. The speaker and LED operating for a period to include but not be limited to 30-60 seconds after a drop is detected. Said front lid 4 having a childproof and waterproof perimeter connection and being selectively removable to allow access to microcontroller 3 to replace said battery. Other embodiments of the invention may have but are not limited to vibrations, geo-location capabilities along with related software app for mobile devices. FIG. 5 showing an infant using the invention. The pacifier being used by a wide array of youngsters including but not limited to infants, babies, toddlers, young children and the like.

It is additionally noted and anticipated that although the device is shown in its most simple form, various components and aspects of the device may be differently shaped or slightly modified when forming the invention herein. As such those skilled in the art will appreciate the descriptions and depictions set forth in this disclosure or merely meant to portray examples of preferred modes within the overall scope and intent of the invention, and are not to be considered limiting in any manner. While all of the fundamental characteristics and features of the invention have been shown and described herein, with reference to particular embodiments thereof, a latitude of modification, various changes and substitutions are intended in the foregoing disclosure and it will be apparent that in some instances, some features of the invention may be employed without a corresponding use of other features without departing from the scope of the invention as set forth. It should also be understood that various substitutions, modifications, and variations may be made by those skilled in the art without departing from the spirit or scope of the invention.

What is claimed is:

1. An infant pacifier comprised of the following main parts:

(a) a rigid case;

(b) a microcontroller;

(c) a shock sensor;

(d) a speaker;

(e) an audible alarm;

(f) a LED;

(g) a battery;

(h) a flexible nipple; and wherein said microcontroller and said shock sensor are configured to detect a bounce when said infant pacifier is dropped such that detecting the bounce generates an audible alert and a visual alert.

2. The infant pacifier of claim 1, wherein the rigid case having a waterproof and childproof lid.

3. The infant pacifier of claim 2, wherein the lid is configured to be removable.

4. The infant pacifier of claim 1, wherein the rigid case having a recess to receive said microcontroller, shock sensor, LED, and speaker.

5. A method for notifying when a pacifier is dropped, the method comprising:

providing a pacifier having a rigid case, a microcontroller, a shock sensor, a speaker, an audible alarm, a LED, a battery and a flexible nipple;

sensing a bounce when the pacifier drops;

generating an audible alert and a visual alert after the shock sensor and microcontroller detect the pacifier drops.

6. The method of claim 5, wherein the audible alert is emanated from the speaker.

7. The method of claim 5, wherein the visual alert is emanated from said LED.

8. The method of claim 5, wherein generating the audio and visual alerts are activated for a specific timeframe.

* * * * *